US009539491B2

(12) United States Patent
Payne et al.

(10) Patent No.: US 9,539,491 B2
(45) Date of Patent: Jan. 10, 2017

(54) APPARATUS AND METHOD FOR CLEANING BOWLING BALLS

(76) Inventors: Angela M. Payne, Woodbridge, VA (US); Lemuel C. Payne, Jr., Woodbridge, VA (US)

( * ) Notice: Subject to any disclaimer, the term of this patent is extended or adjusted under 35 U.S.C. 154(b) by 1133 days.

(21) Appl. No.: 13/487,248

(22) Filed: Jun. 3, 2012

(65) Prior Publication Data

US 2013/0319474 A1 Dec. 5, 2013

(51) Int. Cl.
*A63D 5/10* (2006.01)

(52) U.S. Cl.
CPC ..... *A63D 5/10* (2013.01)

(58) Field of Classification Search
None
See application file for complete search history.

(56) References Cited

U.S. PATENT DOCUMENTS 3,038,986 A * 6/1962 Molitor ..... A47B 31/02 126/33
4,024,377 A * 5/1977 Henke ..... A47J 27/004 219/430
4,140,893 A * 2/1979 Renteria ..... A63B 47/005 219/385
4,260,480 A * 4/1981 Lewis ..... B04C 5/28 209/728
4,450,667 A * 5/1984 Fitzpatrick ..... A63B 47/00 219/521
2004/0022948 A1* 2/2004 Brown ..... A63B 45/00 427/314

* cited by examiner

*Primary Examiner* — Nicole Blan

(74) *Attorney, Agent, or Firm* — Patent Service Associates; Lyman Smith

(57) ABSTRACT

A compact and portable bowling ball cleaner apparatus has a controlled heated temperature/timed steam process that properly and effective removes oil and dirt from the pores and surface of reactive bowling balls and gives restored life and performance to the ball without changing the coverstock or mechanics. The cleaner apparatus is not only cost effective, but a must have product for any avid/league/pro bowler that uses reactive bowling balls. The cleaner apparatus provides an effective, safe, affordable, user friendly, compact and attractive solution for removing oil and dirt from bowling balls.

10 Claims, 4 Drawing Sheets

APPARATUS AND METHOD FOR CLEANING BOWLING BALLS

BACKGROUND OF THE INVENTION

The present invention relates to apparatus and methods for cleaning bowling balls and, more particularly, to an electrically driven aluminum structured sweat box that removes oil and dirt from bowling balls.

Oil build up on bowling balls (typically made of plastic, reactive resin, urethane, or a combination thereof) causes the bowling ball to lose its performance capability and "hookability" over time, which is the most important function of a reactive bowling ball. Reactive bowling balls have cores inside the ball which is dynamically imbalanced to cause the ball to try to stabilize as it is rolling down the bowling lane. This makes the ball roll over a different point on the surface every time it revolves and flares or causes multiple rings of oil as it travels down the lane. Over time, this oil builds up and clogs the pores of the bowling ball. In order to maintain maximum performance, these types of bowling balls must have the oil and dirt accumulation extracted from the pores in order to function at the highest performance potential for which it was designed.

There are many horror stories of how to remove oil from bowling balls. People have desperately tried all sorts of things, from putting the ball in ovens, cat litter, dishwashers, microwaves, heat lamps, sitting in the sun for hours, putting in a hot car trunk in hot summer heat, soaking it in a bucket or tub of hot water, and the like. None of these processes, however, are the most effective way of removing dirt and oil from the bowling ball; nor are they good for the bowling ball.

A conventional dry heat process is used for cleaning bowling balls. This process, however, is known to remove some of the plasticizers from the ball, which is undesirable because the plasticizers help the reactive ball to "hook". This process is often performed in pro shops because of its cost, large size and unavailability for home use to the general bowling public (league, casual, pro bowlers, etc.). Additionally, pro shops can charge, for example, $30-50 per visit to put a bowling ball through this cleaning process. Pro Shops are also far, few and in between, making it inconvenient for bowlers to get the proper maintenance for their bowling balls as recommended.

Another conventional system provides a hot water bath (immersing the ball completely in water) for the bowling ball to be cleaned in. Such systems, however, may result in water not getting fully removed from the ball, for example, staying in the finger holes of the ball and getting into the pores, resulting in the user having to wait before use for the ball to dry, or try to manually dry the ball after cleaning.

As can be seen, there is a need for an improved method and system for removing dirt and oil from a bowling ball. There is also a need to make this method/equipment available to the general bowling public.

SUMMARY OF THE INVENTION

In one aspect of the present invention, a bowling ball cleaner apparatus comprises a housing having a housing bottom and an opening in a top face thereof; a well assembly adapted to fit into the opening; a heating band element adapted to warm the well assembly; a vented well insert adapted to fit into the well assembly, the vented well insert having a plurality of vents formed at least in a bottom surface thereof; a plurality of risers extending from the bottom surface of the vented well insert, the risers adapted to support a bowling ball disposed within the vented well insert; and a dome adapted to cover the vented well insert.

In another aspect of the present invention, a bowling ball cleaner apparatus comprises a housing having a housing bottom and an opening in a top face thereof; a well assembly adapted to fit into the opening; a heating band element adapted to warm the well assembly; a vented well insert adapted to fit into the well assembly, the vented well insert having a plurality of vents formed at least in a bottom surface thereof; a plurality of risers extending from the bottom surface of the vented well insert, the risers adapted to support a bowling ball disposed within the vented well insert; a dome adapted to cover the vented well insert; a timer adapted to control how long power is supplied to the heating band element; a switch adapted to switch power on and off to the heating band element; a well bracket disposed between the housing bottom and the well assembly; and insulation disposed between the housing and the well assembly.

In a further aspect of the present invention, a method for cleaning a bowling ball comprises placing the bowling ball into a vented well insert, the vented well insert having vents to allow steam to pass therethrough, the vented well insert disposed in a well assembly containing water; heating the water in the well assembly to generate steam; and allowing the steam to clean the bowling ball and carry dirt and oil from the bowling ball into the water in the well assembly.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a compact and portable bowling ball cleaner apparatus that has a controlled heated temperature/timed steam process that properly and effectively removes oil and dirt from the pores of reactive bowling balls and gives restored life and performance to the ball without changing the coverstock or mechanics. The cleaner apparatus is not only cost effective, but a must have product for any avid/league/pro bowler that uses reactive bowling balls. The cleaner apparatus of the present invention provides an effective, safe, affordable, user friendly, compact and attractive solution for removing oil and dirt from bowling balls.

Figure 1:
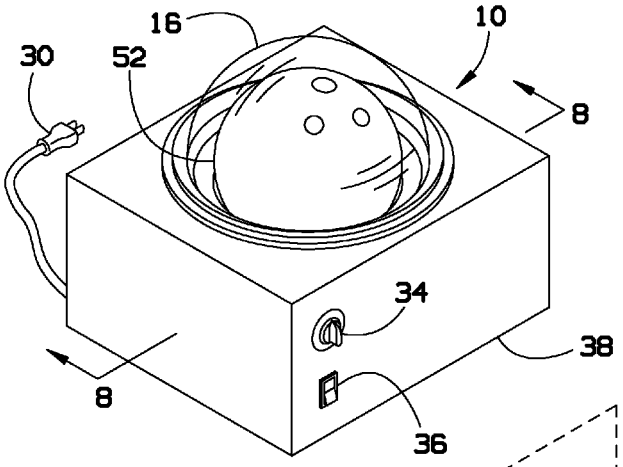
FIG. 1 is a perspective view of a bowling ball cleaner apparatus according to an exemplary embodiment of the present invention.

Referring now to FIGS. 1 through 11, especially FIG. 1, a bowling ball cleaner apparatus 10 includes a housing 38 with a dome 16 extending from a top side thereof. A power cord 30 may extend from the housing 38. A timer 34 and a power switch 36 may be disposed on a control region 40 of the housing 38. A bowling ball 52 can fit under the dome 16.

Figure 4:
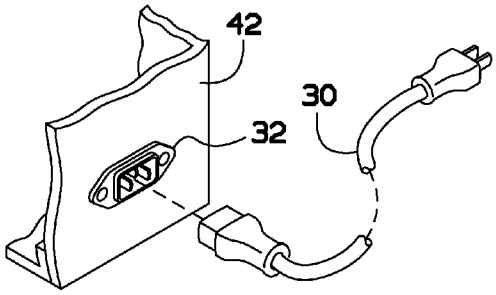
FIG. 4 is a detailed perspective view of a power supply connector used in the bowling ball cleaner apparatus of FIG. 1.

The housing 38 may be made from various materials, such as metal, plastic, composite or the like. In some embodiments, the housing 38 may be made from aluminum, such as 0.063 gauge aluminum, with a powder-coated finished that can be in assorted colors. The dome 16 may be an acrylic dome, also available in various colors. The timer 34 may be a sixty minute, spring-wound timer that controls a time of a cleaning cycle of the cleaner apparatus 10. The power switch 36 may be an on/off rocker switch that may include illumination to indicate power being on. The power cord 30 may be adapted to connect to a standard electrical outlet and carry electricity to the cleaner apparatus 10. In some embodiments, the power cord 30 may be a six-foot, sixteen-AWG power cord. The power cord 30 may plug into an AC inlet 32, typically located on a back side 42 of the housing 38, as shown in FIG. 4.

Figure 2:
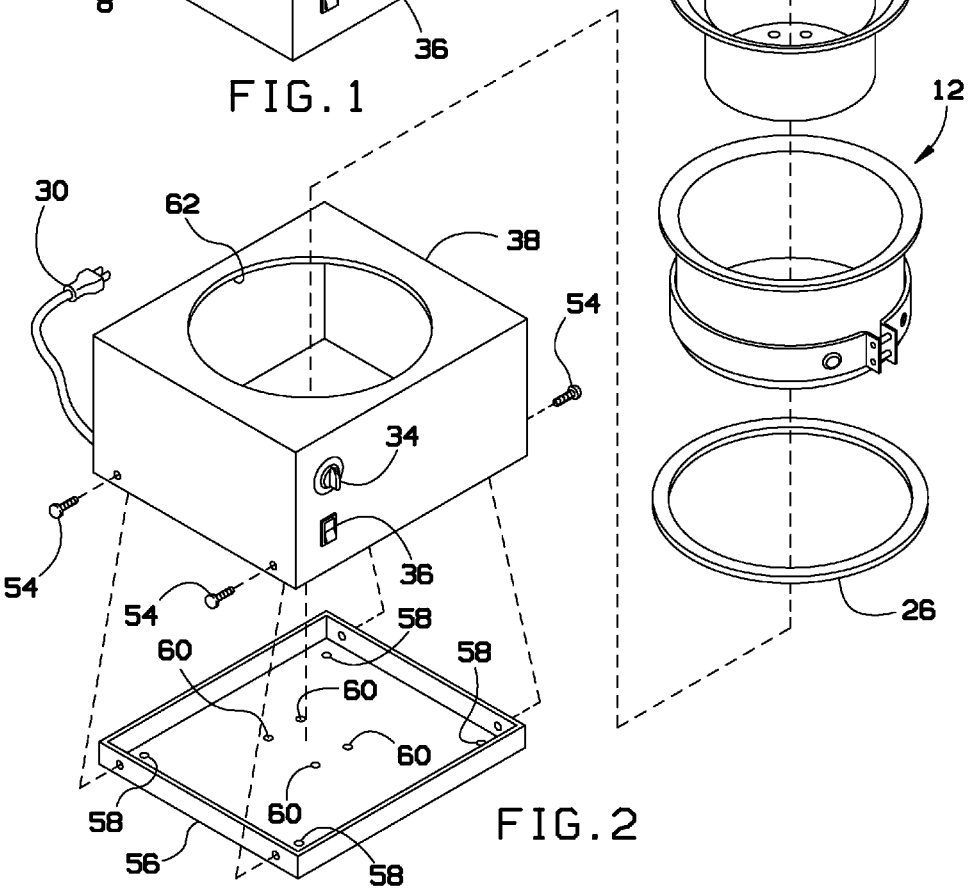
FIG. 2 is an exploded perspective view of the bowling ball cleaner apparatus of FIG. 1.
Figure 3:
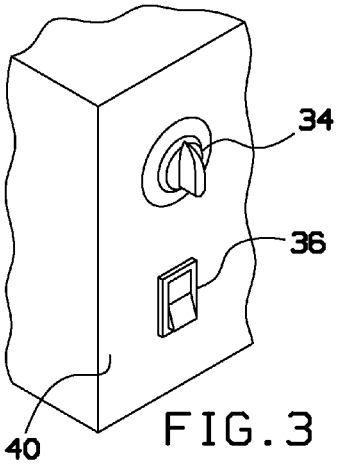
FIG. 3 is a detailed perspective view of a switch and timer used in the bowling ball cleaner apparatus of FIG. 1.

As shown in FIG. 2, the housing 38 includes an opening 62 into which a well assembly 12 is disposed therewithin. The well assembly 12 may include a well 24 that fits into the opening 62. A well gasket 26 can create a seal between the well 24 and the housing 38. A heating band element 28 may fit around the well assembly 12, typically about a lower portion of the well assembly 12. The well assembly 12 may be made from various materials, such as stainless steel.

A vented well insert assembly 14 may fit inside the well assembly 12 and includes a plurality of vents 68 formed in a bottom portion thereof. The vents 68 can provide an evenly distributed circulation of steam therethrough from water that is heated in the well assembly 12 by the heating band element 28. The vented well insert assembly 14 may be made from various materials, such as aluminum, for example.

Figure 7:
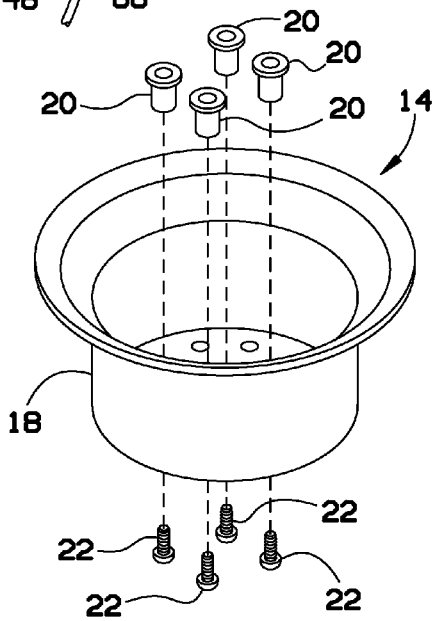
FIG. 7 is an exploded perspective view of a vented aluminum well insert assembly used in the bowling ball cleaner apparatus of FIG. 1.

A plurality of risers 20, such as four rubber risers as shown in FIG. 7, may be disposed onto the bottom of a vented well insert 18 of the vented well insert assembly 14, connected by screws 22, for example, to hold the bowling ball 52 sturdy and above the bottom of the well insert. In some embodiments, the risers 20 may be rolling elements and one or more of the risers 20 may be adapted to rotate when the power is turned on to the cleaner apparatus 10, causing the bowling ball 52 to rotate slowly while being cleaned.

Figure 8:
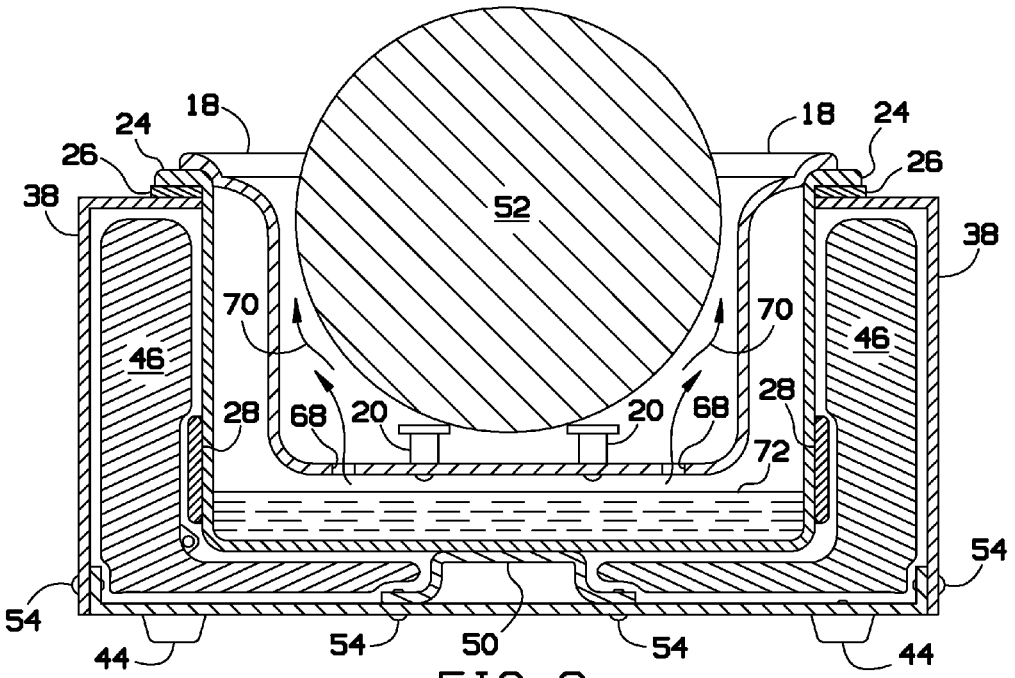
FIG. 8 is a cross-sectional view taken along line 8-8 of FIG. 1.
Figure 9:
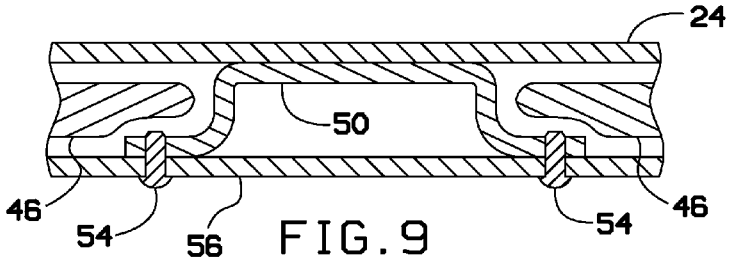
FIG. 9 is a cross-sectional view showing a well bracket and aluminum housing body of the bowling ball cleaner apparatus of FIG. 1.

The vented well insert assembly 14 can sit inside the well assembly 12, but is retained above the bottom of the well assembly 12 such that the bottom of the insert assembly 14 does not contact the bottom of the well assembly 12, allowing water 72 to be disposed therebetween, as shown in FIG. 8.

Figure 6:
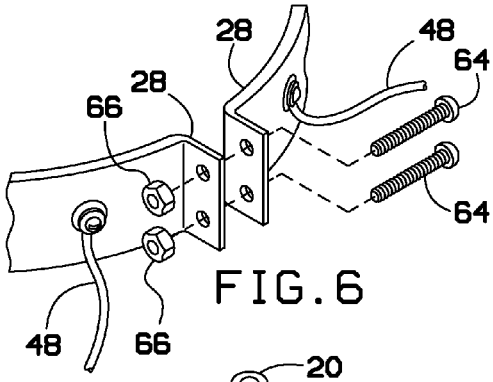
FIG. 6 is a detailed perspective view of a heating band element used in the bowling ball cleaner apparatus of FIG. 1.

The heating band element 28 may wrap around the well assembly 12. Wires, such as high-temperature wires 48 may provide power to the heating band element 28 as shown in FIG. 6. Heating band element mounting screws 64 and nuts 66 may be used to secure the heating band element 28 around the well assembly 12.

Figure 10:
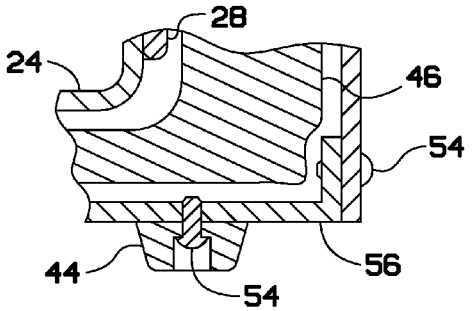
FIG. 10 is a detailed cross-sectional view of rubber feet and the aluminum housing body of the bowling ball cleaner apparatus of FIG. 1.

Referring back to FIG. 2, a housing bottom 56 may be disposed on the bottom side of the housing 38. The housing bottom 56 may be made from various materials, such as aluminum. The housing bottom 56 may be connected to the housing 38 by various mechanisms, such as sheet metal screws 54. Rubber feet mounting holes 58 may be disposed in the bottom of the housing bottom 56 for attaching feet, such as rubber feet 44 with, for example, a sheet metal screw 54, as shown in FIG. 10.

Referring now to FIG. 8, fire retardant insulation 46 may be disposed between the housing 38 and the well assembly 12 to minimize heat transfer to the housing 38 during use, when steam 70 is generated from the water 72 and the steam 70 passes into the vented well insert 18 to clean the ball.

Figure 5:
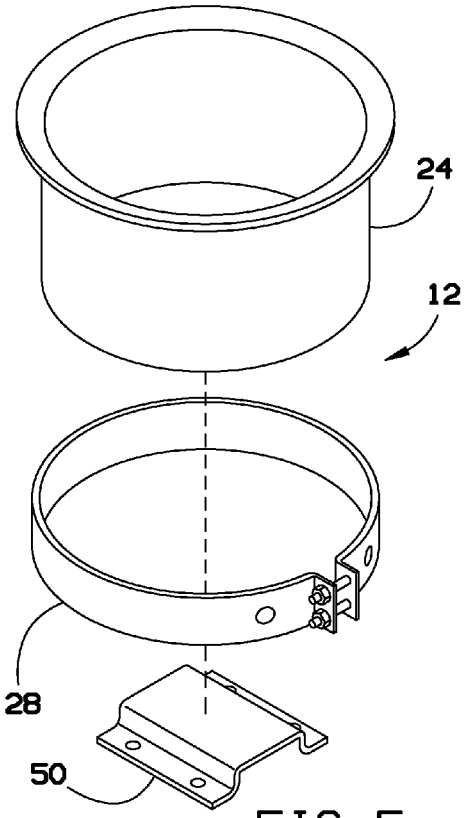
FIG. 5 is an exploded perspective view of a stainless steel well assembly used in the bowling ball cleaner apparatus of FIG. 1.

A well bracket 50, as shown in FIG. 5, may attach to the housing bottom 56 via well bracket mounting holes 60. The well bracket 50 may lift the well assembly 12 away from the housing bottom 56 to limit the heat transfer from the well assembly 12 to the housing bottom 56 and the housing 38.

Figure 11:
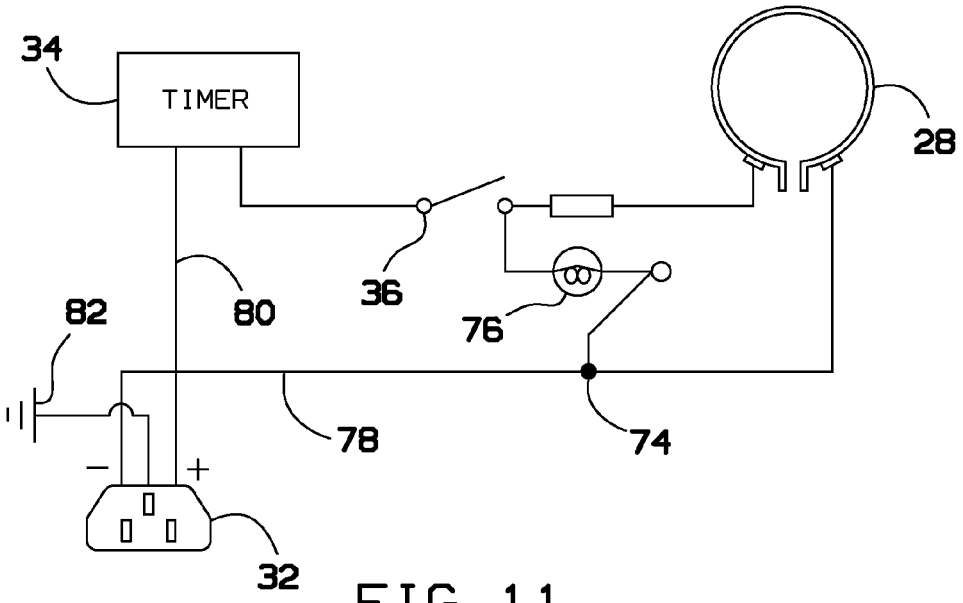
FIG. 11 is an electrical schematic diagram for the bowling ball cleaner apparatus of FIG. 1.

Referring now to FIG. 11, an electrical schematic is shown. The AC inlet 32 may be properly connected with ground 82 and may deliver neutral 78 and hot 80 power to the circuit. The hot power may pass through the timer 34 and the switch 36, controlling the flow of current. When the timer 34 is activated and the switch 36 closed, an indicator light 76 may illuminate to indicate the unit is on. A wire splice 74 may be used to connect neutral 78 to the indicator light 76. When power is on, the heating element 28 receives power to heat water in the well assembly 12. The switch 36 may be a single pole single throw (SPST) rocker switch, for example, however, other switches that achieve the same function may be used within the scope of the present invention.

The invention function is to effectively and safely remove oil and dirt particles from the bowling ball 52 by use of an electrically generated steam process to maximize the ball performance. The cleaner apparatus 10 works by placing the recommended amount of water to the fill line inside the well assembly 12. The vented aluminum well insert 14 is placed inside of the stainless steel well assembly 12. The bowling ball 52 is then placed inside of the vented aluminum well insert 14, securely on the rubber risers 20. The bowling ball 52 is then covered with the acrylic dome top 16. The electrical cord 30 is plugged into an outlet and the dial timer 34 is set to the desired cleaning time indicated on the dial label, as for example, light oil—30 minutes., medium oil—45 minutes. or heavy oil—60 minutes. The switch 36 is turned ON, illuminating the switch to indicate the machine is started. The machine will do the rest. After the selected cleaning time is completed, the machine will shut off automatically and the indicator light will turn off. If, in the middle of cleaning, a user can stop the timer by turning the switch 36 to OFF position.

This unit is designed in a single, double or multiple ball housing, for example, where the housing 38 may be designed to hold one or more well assemblies, each well assembly holding a bowling ball 52.

To use the bowling ball cleaner apparatus 10, a user simply puts in the appropriate amount of water into the well assembly 12 and starts the device. The steam generated by the device cleans the ball of dirt and oil.

Various additional features and options may be included within the scope of the present invention. For example, while the device is designed as a portable device, where the user can simply remove the well insert 14 to change/empty the water and add new water, the well assembly 12 could include a drain with a stopcock, for example, to permit the water to drain without having to lift out the well assembly 12. Such embodiments may be useful for ball cleaners adapted to clean two or more balls, where the well assembly 12, with the water, may be heavy. Also, the manual timer could be replaced with a digital timer, for example. Moreover, an audible alert may be added to signal that the timer has expired and the bowling ball cleaning cycle is complete.

It should be understood, of course, that the foregoing relates to exemplary embodiments of the invention and that modifications may be made without departing from the spirit and scope of the invention as set forth in the following claims.

What is claimed is:

1. A bowling ball cleaner apparatus comprising:

a housing having a housing bottom and an opening in a top face thereof;

a well assembly adapted to fit into the opening, the well assembly having a solid bottom portion, sides and an open top defined by the sides, wherein the well assembly contains a liquid therein, wherein the liquid covers the solid bottom portion and extends to the sides;

a heating band element adapted to warm the well assembly sufficiently to create a vapor of at least a portion of the liquid;

a vented well insert adapted to fit into the well assembly, the vented well insert having a plurality of vents formed at least in a bottom surface thereof;

a plurality of risers extending from the bottom surface of the vented well insert, the risers adapted to support a bowling ball disposed within the vented well insert; and a dome adapted to cover the vented well insert.

2. The bowling ball cleaner apparatus of claim 1, wherein the bottom surface of the vented well insert is spaced from a bottom surface of the well assembly when the vented well insert is inserted inside the well assembly.

3. The bowling ball cleaner apparatus of claim 1, further comprising a timer adapted to control how long power is supplied to the heating band element.

4. The bowling ball cleaner apparatus of claim 1, further comprising a switch adapted to switch power on and off to the heating band element.

5. The bowling ball cleaner apparatus of claim 1, further comprising a well bracket disposed between the housing bottom and the well assembly.

6. The bowling ball cleaner apparatus of claim 1, further comprising insulation disposed between the housing and the well assembly.

7. The bowling ball cleaner apparatus of claim 1, further comprising a gasket disposed between the well assembly and the housing.

8. A bowling ball cleaner apparatus comprising:

a housing having a housing bottom and an opening in a top face thereof;

a well assembly adapted to fit into the opening, the well assembly having a solid bottom portion, sides and an open top defined by the sides, wherein the well assembly contains a liquid therein, wherein the liquid covers the solid bottom portion and extends to the sides;

a heating band element adapted to warm the well assembly sufficiently to create a vapor of at least a portion of the liquid;

a vented well insert adapted to fit into the well assembly, the vented well insert having a plurality of vents formed at least in a bottom surface thereof;

a plurality of risers extending from the bottom surface of the vented well insert, the risers adapted to support a bowling ball disposed within the vented well insert;

a dome adapted to cover the vented well insert;

a timer adapted to control how long power is supplied to the heating band element;

a switch adapted to switch power on and off to the heating band element;

a well bracket disposed between the housing bottom and the well assembly; and insulation disposed between the housing and the well assembly.

9. The bowling ball cleaner apparatus of claim 8, wherein the bottom surface of the vented well insert is spaced from a bottom surface of the well assembly when the vented well insert is inserted inside the well assembly.

10. The bowling ball cleaner apparatus of claim 8, further comprising a gasket disposed between the well assembly and the housing.

* * * * *